US007878816B2

(12) United States Patent
Zhu

(10) Patent No.: US 7,878,816 B2
(45) Date of Patent: Feb. 1, 2011

(54) ELECTRICAL CONNECTOR TRANSMITTING HIGH FREQUENCY SIGNAL

(75) Inventor: Yu Zhu, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/471,418

(22) Filed: May 25, 2009

(65) Prior Publication Data

US 2010/0009555 A1 Jan. 14, 2010

(30) Foreign Application Priority Data

Jul. 8, 2008 (CN) ..... 2008 2 0040692
Jul. 21, 2008 (CN) ..... 2008 2 0041961

(51) Int. Cl.
*H01R 12/00* (2006.01)

(52) U.S. Cl. ..... 439/65; 439/79; 439/660

(58) Field of Classification Search ..... 439/65, 439/79, 660, 78, 329
See application file for complete search history.

(56) References Cited

U.S. PATENT DOCUMENTS 5,928,035 A 7/1999 Otto
5,984,698 A 11/1999 Molex
6,832,934 B1 * 12/2004 Zhang ..... 439/660
D563,876 S * 3/2008 Masubuchi et al. ..... D13/147

* cited by examiner

*Primary Examiner*—Briggitte R Hammond
(74) *Attorney, Agent, or Firm*—Wei Te Chung; Andrew C. Cheng; Ming Chieh Chang

(57) ABSTRACT

An electrical connector includes an insulating housing (1) includes a base (11) and a mating portion (13) extending forwards from the base and a set of terminals (4). Each terminal includes a retaining portion (43) retained in the base, a contacting portion (41) located on the mating portion and a connecting portion (44) extending from the retaining portion and behind a rear face of the base. The base defines a recessing portion around the retaining portions of the set of terminals at the rear face of the base to partially expose said retaining portions in an atmosphere.

20 Claims, 6 Drawing Sheets

ELECTRICAL CONNECTOR TRANSMITTING HIGH FREQUENCY SIGNAL

BACKGROUND OF THE INVENTION

1. Field of the Invention

The present invention relates to an electrical connector, and more particularly to an electrical connector transmitting high frequency signal.

2. Description of the Related Art

High frequency connectors widely used in modern industry, have some urged questions to be solved, such as cross-talk and impedance matching. To settle said question, some connectors define grounding terminals between two adjacent signal terminals to overcome cross-talk and some connectors define a metal shielding shell surrounded an insulating housing to overcome EMI (Electromagnetic Interference). Especially in some connectors with longer and slender terminals has said outstanding issues, for example, in SAS (Serial Attached SCSI) connectors.

BRIEF SUMMARY OF THE INVENTION

It is an object of the present invention to provide an electrical connector with improved resistance characteristic.

In order to achieve the objective above, an electrical connector includes an insulating housing includes a base and a mating portion extending forwards from the base and a set of terminals. Each terminal includes a retaining portion retained in the base, a contacting portion located on the mating portion and a connecting portion extending from the retaining portion and behind a rear face of the base. The base defines a recessing portion around the retaining portions of the set of terminals at the rear face of the base to partially expose said retaining portions in an atmosphere.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like members in the figures and in which:

DESCRIPTION OF PREFERRED EMBODIMENT OF THE INVENTION

In the following detailed description, for purposes of explanation, numerous specific details are set forth in order to provide a thorough understanding of the present invention.

Figure 1:
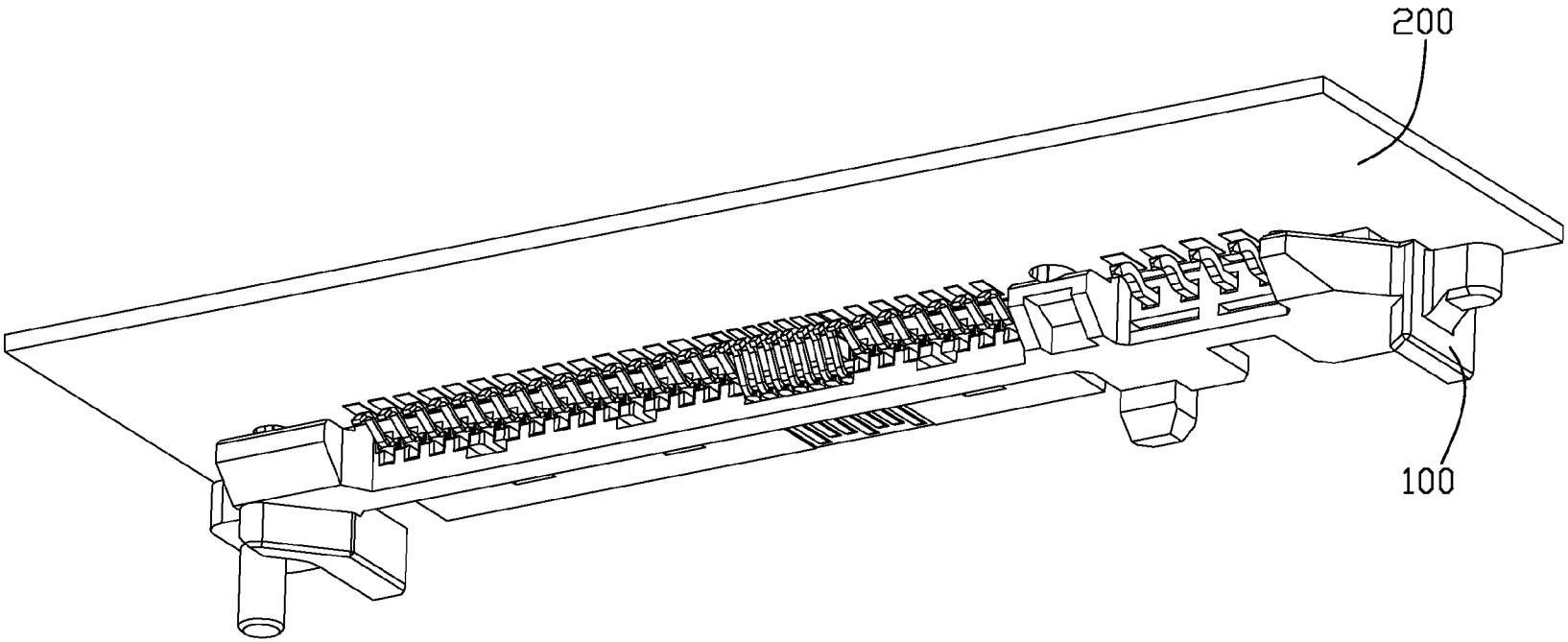
FIG. 1 is a perspective view of an electrical connector according to the embodiment of the present invention, which is assembled with a PCB.
Figure 2:
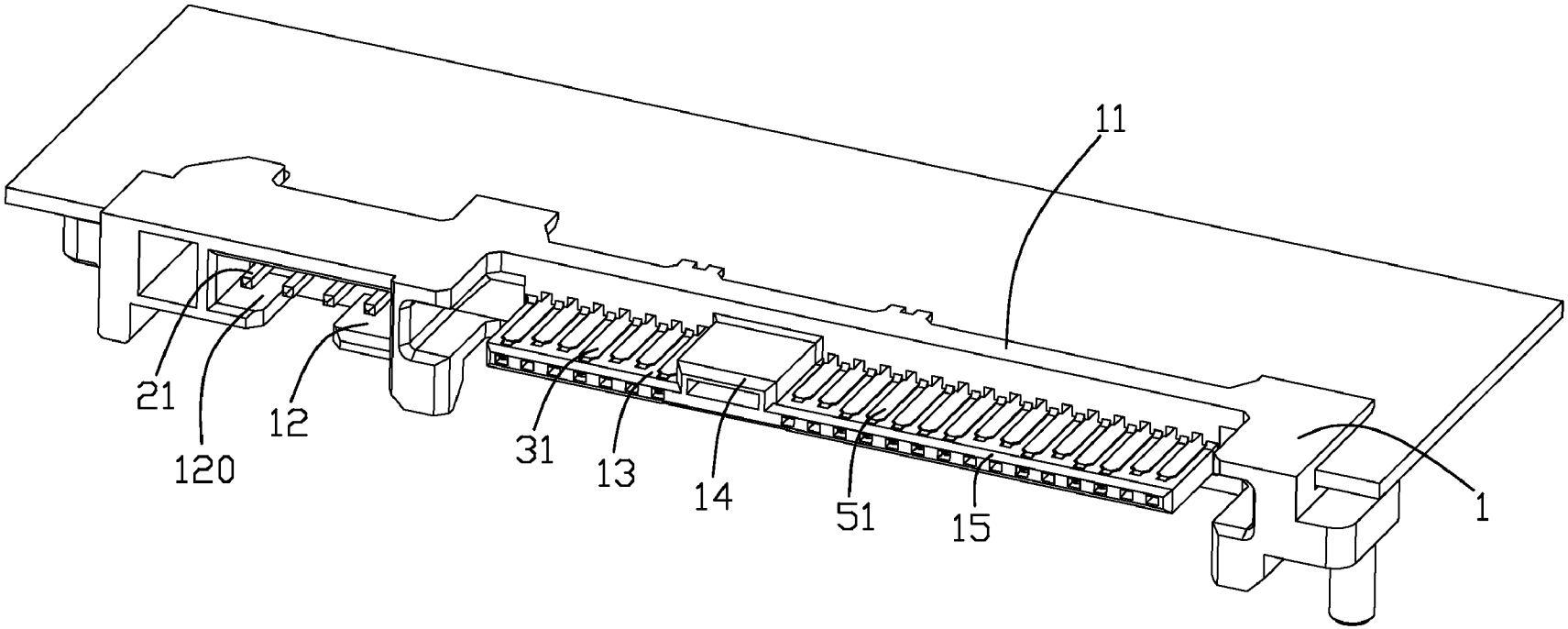
FIG. 2 is a perspective view of the electrical connector of FIG. 1 from another view.

Please refer to FIG. 1 to FIG. 2, an electrical connectors 100 according to the embodiment of present invention is assembled with a PCB (Printed Circuit Board) 200 on a rear end of the connector and a plurality of terminals of the connector are electrically and mechanically connected with the PCB 200.

Figure 3:
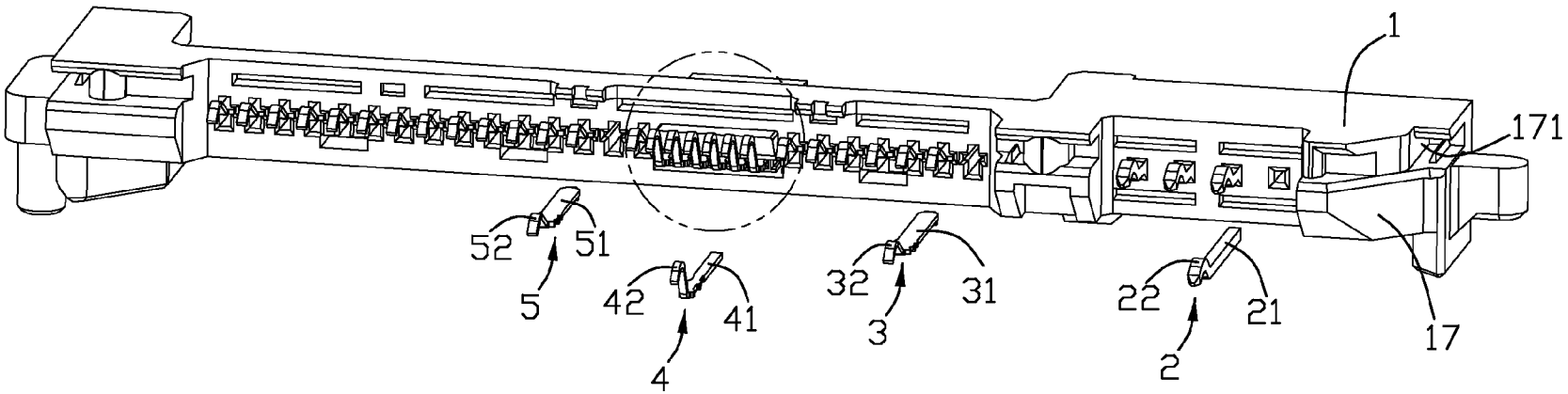
FIG. 3 is a partly exploded view of the electrical connector from a rear view.

Refer to FIG. 2 to FIG. 3, the connector includes an insulating housing 1 configured as a longitudinal rectangular. The housing includes a longitudinal base 11 and a plurality of mating portions projecting forwards from the base 11. The plurality of mating portions are arranged side-by-side along a longitudinal direction of the base 11, which are defined as a first mating portion 12 through a forth mating portion 15 in order started from left side. The first mating portion 12 is configured as a frame with an inside mating room 120 and four first pin terminals 2 are retained in the base 11 with front ends/contacting portions 21 projecting into the mating room 120. The second mating portion 13 is configured as a tongue projecting forwards and a set of second terminals 3 are retained in the base with front blade ends/contacting portions 31 embedded in a top face of the tongue 13. Front ends/contacting portions 41 of third terminals 4 are inserted in the third mating portion 14. Front ends/contacting portions 51 of forth terminals 5 are embedded in a top face of the forth mating portion 15 similar to the second mating portion 13. Referring to FIG. 3, the rear ends of said four set terminals are slant upward and then downward to form pressing portions 22, 32, 42, 52. The third terminals are thinner compared with the second terminals and forth terminals.

The insulating housing has a pair of flanges 17 extending rearwards at two opposite ends thereof and the flanges 17 define slots 171 opening sideway and rearwards. The PCB 200 is inserted into the slots 171 and retained at the rear end of the housing. Said pressing portions 22~52 are firmly abutting against corresponding pads of the PCB 200 as clearly shown in FIG. 1.

Figure 4:
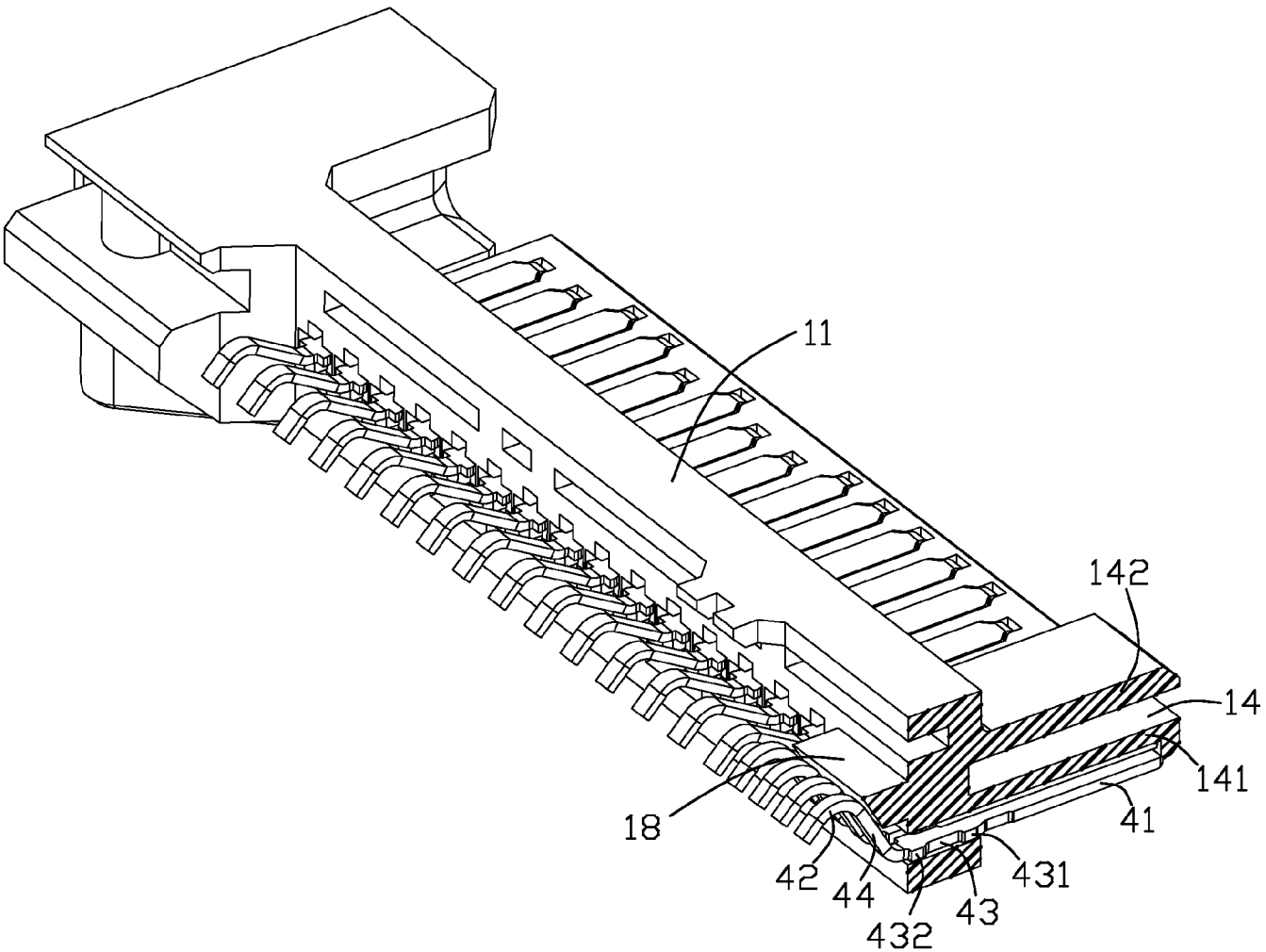
FIG. 4 is a perspective view of the electrical connector, wherein the right part of the connector is cut away to shown the terminals.

Please refer to FIG. 4, the third mating portion 14 is formed by two parallel upper and lower tongues 141, 142 extending forward from the base 11. The blade contacting portions 41 of the third terminals are located in the lower face of the lower tongue 141 and the pressing portions are located behind the base 11. A retaining portion of the third terminals is defined between the contacting portion 41 and the rear end, which has two barbs 431, 432 at each lateral side along a mating direction to interference with the base 11. The rear end of the third terminal 4 has a connecting portion 44 between the retaining portion 43 and the pressing portion 42, which slant upwards and outwards with a predetermined angle.

The base 11 unitarily extends a supporting portion 18 from a rear face thereof corresponding to the third mating portion 14. The supporting portion 18 defines a planar supporting face 181 at the rear face thereof, which slants inward and downward. The inclined angle of the supporting face 181 is in consistence with the predetermined angle of the connecting portions 44, thereby the connecting portions 44 can abut against the supporting face 181. Combination with FIG. 5, the contacting portions of the third terminals 4 are nearer to the bottom of the housing compared with other terminals so that the connecting portions 44 of the third terminals are longer than other connecting portions of the other terminals 2, 3, 5.

The supporting face 181 benefit the third terminals 4 from damage and curved when the connector 100 are assembled with the PCB 200. Alternatively, the housing defines other supporting portions at the rear face corresponding to the first, third and/or the forth mating portions.

Figure 5:
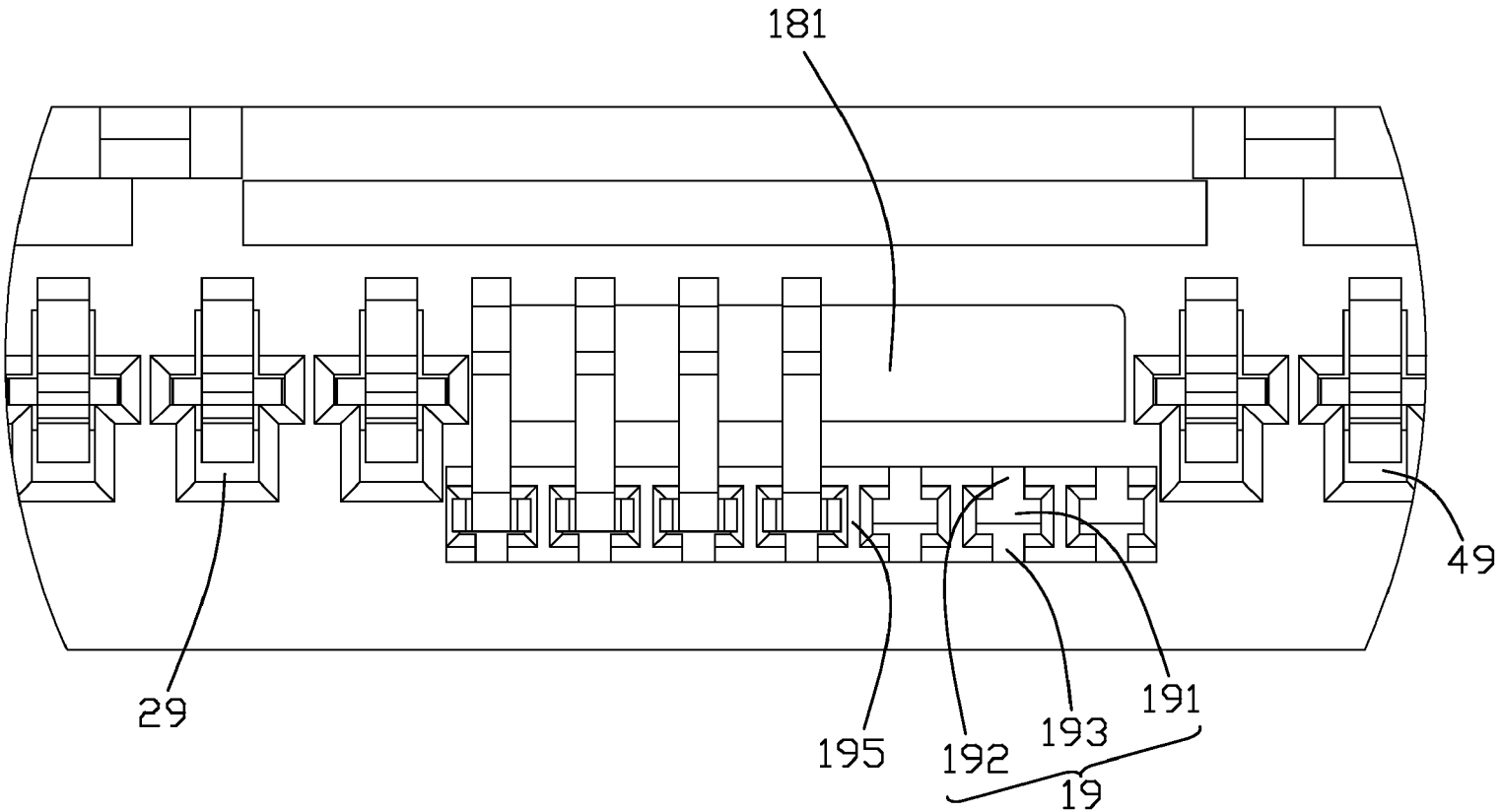
FIG. 5 is an enlarge rear elevational view of the electrical connector, wherein several terminals are taken away.

Referring to FIG. 5, the housing defines passageways 19, 29, 49 run through the front portion and the rear portion of the housing 1 and are arranged along the longitudinal direction to receive the terminals. The set of passageway 19 receiving the third terminals 4 named as the third passageway 19, each includes a retaining portion 191 and two matching portion 192, 193 respectively located below and above the retaining portion 191. The retaining portions 191 are used to interference with the barbs 431, 432 to retain the third terminals 4. The matching portion 192, 193 communicate with the retaining portion 191 and used to exposure the third terminals 4 in the atmosphere as much as possible, as a result the resistance characteristic of the third terminals can be adjusted to match electric performance of the connector 100. The matching portions are not through the front face of the base 11.

Figure 6:
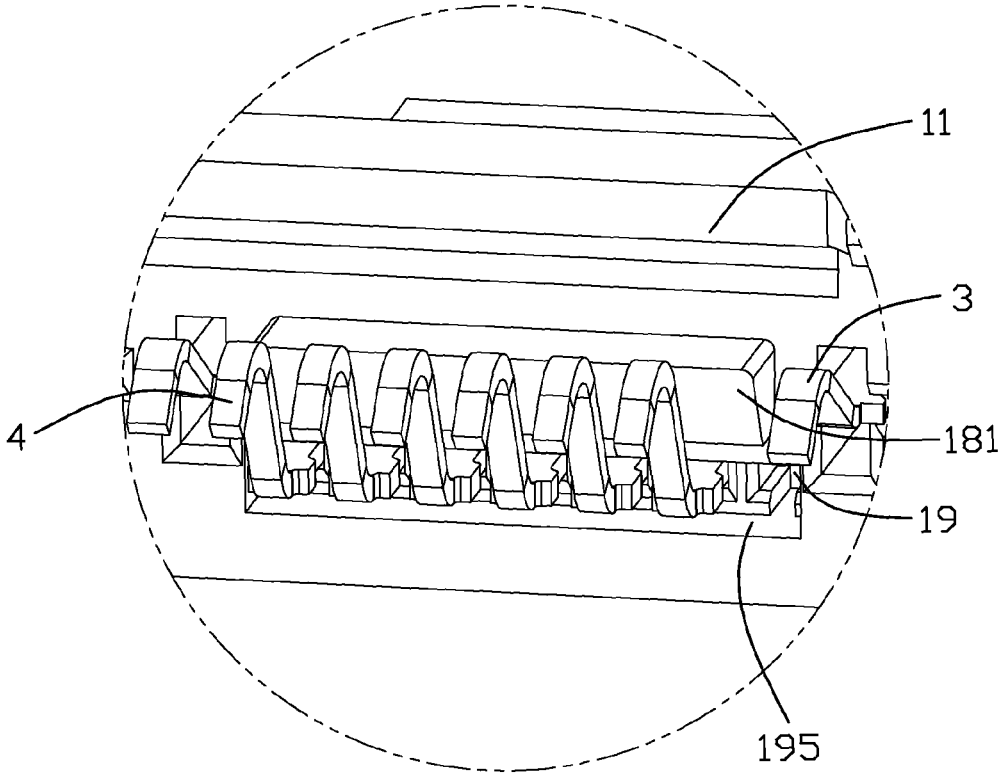
FIG. 6 is an enlarged perspective view of the electrical connector shown in FIG. 3.

Referring to FIG. 5 and FIG. 6, the base 11 defines a recessing portion 195 at the rear face around the third terminals 4. The recessing portion 195 is shallow and exposes the part of the retaining portion 43 such as the barbs 432 of this embodiment as shown in FIG. 4. The capacitance between two adjacent terminals with smaller distance therebetween is larger, which will result in a smaller resistance of the connector. The exposure of the third connector as much as possible will enlarger the resistance of the connector and the recessing portion 195 will increase exposure of the terminals on the basis of terminals' steady immobilization in the housing. The recessing portion 195 is unitary around all the third terminals, i.e. the set of the third terminals 4. Alternatively, other portions of the housing can be arranged as such configuration to expose other set of the other terminals.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulating housing comprising a base and a mating portion extending forwards from the base;

a set of terminals, each comprising a retaining portion retained in the base, a contacting portion located on the mating portion and a connecting portion extending from the retaining portion and behind a rear face of the base;

wherein the housing define a set of passageways to receive said set of terminals, each passageway comprises a retaining region to interferingly retaining the retaining portions of the terminals;

wherein the base defines a recessing portion perpendicularly communicating with the passageways and around the retaining portions of the set of terminals at the rear face of the base to partially expose said retaining portions in an atmosphere.

2. The electrical connector as recited in claim 1, wherein the recessing portion is formed unitarily.

3. The electrical connector as recited in claim 2, wherein the retaining portion of the terminal defines barbs at lateral sides thereof and part of the barbs expose to the atmosphere.

4. The electrical connector as recited in claim 1, wherein the terminal comprises a pressing portion of arc shape at a rear end opposite to the contacting portion and the pressing portion is used to press against a printed circuit board which is assembled on the rear face of the housing, said connecting portion connects with the pressing portion and the retaining portion.

5. The electrical connector as recited in claim 4, wherein the base unitarily extends a supporting portion from the rear face thereof and the connecting portions of the set of terminals abut against the supporting portion.

6. The electrical connector as recited in claim 5, wherein the connecting portions the set of terminals abut against a planar rear face of the supporting portion.

7. The electrical connector as recited in claim 1, wherein each passageway further comprises two matching portions located below and above the retaining portion respectively.

8. The electrical connector as recited in claim 7, wherein the matching portions run forward while not through a front face of the base.

9. The electrical connector as recited in claim 1, further comprising other terminals on the housing, the terminals of said set are thinner than the other terminals.

10. An electrical connector comprising:

an insulating housing comprising a base and a mating portion extending forwards from the base;

a set of terminals, each comprising a retaining portion retained in the base, a contacting portion located on the mating portion and a connecting portion extending from the retaining portion and behind a rear face of the base;

wherein the base defines a supporting portion projecting rearward to support the connecting portions of the terminals;

wherein the connecting portion extends slantways and bent reversely to from an arc pressing portion adapted for pressing against a printed circuit board assembled on the rear face of he base;

wherein the supporting portion defines a planar face slanting in consistence with the connecting portions of the set of terminals;

wherein the rear face of the base shallowly recesses inward around the retaining portions of the set of terminals.

11. An electrical connector assembly comprising:

a printed circuit board defining opposite first and second surfaces thereon and a mating edge region including a plurality of conductive pads arranged in one row on the first surface;

an elongated isolative housing extending along a longitudinal direction and defining at least one mating port facing an exterior in a front-to-back mating direction perpendicular to said longitudinal direction and equipped with a mating tongue exposed therein, said mating tongue defining opposite first and second faces thereon;

a plurality of first contacts disposed in the housing with first contacting sections seated upon said first face and first mounting sections in a rear portion of the housing;

a plurality of second contacts disposed in the housing with second contacting sections seated upon said second face and second mounting sections in said rear portion;

said connector defines a mounting plane in which the first mounting sections and the second mounting sections are located and on which said printed circuit board is seated under condition that said mounting plane is essentially closer to the first contacts than to the second contacts in a vertical direction perpendicular to both said longitudinal direction and said front-to-back mating direction;

both said first mounting sections and said second mounting sections being seated upon the corresponding conductive pads, respectively, the second mounting sections extend rearwardly farther than the first mounting sections, wherein each of said second contact defines a connection portion between the contacting section and the mounting section, and said housing including a supporting portion between the connection portions of the second contact and the plane so as to provide a supporting face against which said connection portions abut in a preloaded manner before said printed circuit board has been assembled to the housing and electrically and mechanically connected to the first and second mounting sections.

12. The electrical connector assembly as claimed in claim 11, wherein the housing defines a slot to receive said mating edge region.

13. The electrical connector assembly as claimed in claim 12, wherein said supporting portion is located by one side of the slot.

14. The electrical connector assembly as claimed in claim 11, wherein said housing defines a plurality of first passageways and second passageways to receive the corresponding first contacts and second contacts therein, and both said first passageways and said second passageways terminate around a rear face of the housing and said supporting portion projects rearward upon said rear face.

15. The electrical connector assembly as claimed in claim 14, wherein said rear face defines a recess commonly communicating with the corresponding second passageways for more exposing the corresponding second contacts.

16. The electrical connector assembly as claimed in claim 14, wherein said supporting portion is aligned with said second passageways in the vertical direction.

17. The electrical connector assembly as claimed in claim 15, wherein each of the second contacts includes a retaining portion behind the corresponding contacting section in a coplanar manner therewith, and a rear portion of the retaining portion of each of said second contacts laterally communicates with those of the other second contacts in said recess.

18. The electrical connector as recited in claim 1, wherein said recessing portion is recessed in the rear face so that each of said passageways extending rearward in a front-to-back direction, terminates at the recessing portion rather than at the rear face under condition that rear sections of the retaining portions of the terminals are communicatively exposed, in said recessing portion, to one another in a transverse direction perpendicular to said front-to-back direction.

19. The electrical connector as recited in claim 18, further including another set of passageways receiving another set of terminals therein, wherein said another set of passageways terminate essentially at the rear face of the base.

20. The electrical connector as recited in claim 19, wherein a supporting portion is unitarily formed on the rear face proximate said set of passageways for supporting the connecting portions of said set of terminals.

* * * * *